US009307846B1

(12) United States Patent
Jones et al.

(10) Patent No.: US 9,307,846 B1
(45) Date of Patent: Apr. 12, 2016

(54) COLLAPSIBLE CARRIERS

(71) Applicants: Nathan Locke Harris Jones, Austin, TX (US); Marwin Erick Jansen, Austin, TX (US)

(72) Inventors: Nathan Locke Harris Jones, Austin, TX (US); Marwin Erick Jansen, Austin, TX (US)

( * ) Notice: Subject to any disclaimer, the term of this patent is extended or adjusted under 35 U.S.C. 154(b) by 335 days.

(21) Appl. No.: 13/987,003

(22) Filed: Jun. 24, 2013

Related U.S. Application Data

(60) Provisional application No. 61/706,403, filed on Sep. 27, 2012.

(51) Int. Cl.
*A47D 13/00* (2006.01)
*A47D 13/02* (2006.01)

(52) U.S. Cl.
CPC ..... *A47D 13/025* (2013.01)

(58) Field of Classification Search
CPC ..... A45D 13/025; A45F 4/02; A45F 13/10; A45F 2003/025; A45F 5/00
USPC ..... 224/160, 197, 158, 159
See application file for complete search history.

(56) References Cited

U.S. PATENT DOCUMENTS 1,464,404 A * 8/1923 Blekastad ..... A47D 13/025 224/159
2,854,060 A * 9/1958 Welsh ..... 297/255
3,090,330 A * 5/1963 Best ..... 108/43
3,265,260 A * 8/1966 Romney ..... 224/161
3,799,414 A 3/1974 Fiffer ..... 224/6
4,106,679 A * 8/1978 Hillinger ..... 224/197
4,836,938 A * 6/1989 Kobasic ..... A01M 31/006 224/153
4,901,898 A * 2/1990 Colombo ..... A47D 13/025 224/159
D306,379 S * 3/1990 Kobasic ..... D25/62
4,915,277 A * 4/1990 Larreategui ..... A47D 13/025 224/158
4,962,873 A * 10/1990 Schattel ..... 224/665
5,016,792 A 5/1991 Jay ..... 224/155
D323,426 S 1/1992 Mahvi et al. ..... D3/31
5,222,641 A 6/1993 Medeiros, Jr. ..... 224/161
(Continued)

*Primary Examiner* — Justin Larson
*Assistant Examiner* — Peter Helvey
(74) *Attorney, Agent, or Firm* — Chris Whewell

(57) ABSTRACT

Provided herein are articles useful for carrying and toting various articles, in addition to persons. One of the members of a frame assembly having two members hingedly connected to one another is secured to a shoulder harness, enabling the articles to be worn on the back of a user. A frame member having a seat or cargo grill or other framework is pivotable to an extended position, the pivotal travel of which is limited by the configuration of a loop and its orientation with respect to its contact with the other frame member, which contact simultaneously serves to provide force for supporting mass present on the seat or cargo grill or other framework. The frame assembly members are contoured to conserve space when stored, when the frame members are in a retracted position with respect to one another.

18 Claims, 16 Drawing Sheets

(56) References Cited

U.S. PATENT DOCUMENTS

| | | | | | |
|---|---|---|---|---|---|
| 5,381,941 | A | | 1/1995 | Brune | 224/155 |
| 5,441,186 | A | * | 8/1995 | Halligan | A47D 13/025 224/159 |
| 5,490,620 | A | | 2/1996 | Bergqvist | 224/160 |
| 5,509,590 | A | | 4/1996 | Medeiros, Jr. et al. | 224/161 |
| 5,620,227 | A | | 4/1997 | Brune | 297/4 |
| 5,868,292 | A | | 2/1999 | Stephens et al. | 224/161 |
| 5,868,462 | A | * | 2/1999 | Truax | A45F 4/02 224/155 |
| 6,464,118 | B2 | * | 10/2002 | McUmber | 224/155 |
| 6,662,981 | B2 | * | 12/2003 | McUmber | A45F 3/10 224/155 |
| 6,789,710 | B1 | * | 9/2004 | Szatkowski | A47D 13/025 224/159 |
| 7,004,362 | B2 | | 2/2006 | Boone | 224/161 |
| 7,686,195 | B2 | * | 3/2010 | Bangert | A47D 13/025 224/159 |
| 8,182,030 | B1 | | 5/2012 | Britten | 297/129 |
| 8,584,914 | B1 | * | 11/2013 | Bryce | 224/161 |
| 2004/0021353 | A1 | * | 2/2004 | Lozano et al. | 297/255 |
| 2005/0045674 | A1 | | 3/2005 | Rehbein | 224/160 |
| 2010/0133303 | A1 | * | 6/2010 | Schilly | 224/155 |

* cited by examiner

COLLAPSIBLE CARRIERS

CROSS REFERENCES TO RELATED APPLICATIONS

This application claims the benefit of U.S. Provisional Application No. 61/706,403 filed Sep. 27, 2012, the entire contents of which are herein incorporated by reference.

TECHNICAL FIELD

This invention relates generally to articles worn on the back of a person. More particularly, it relates to carriers useful for toting persons and objects on one's back.

BACKGROUND OF THE INVENTION

The statements in this background section merely provide background information related to the present disclosure and may not constitute prior art.

Various articles and devices have been contrived to enable a person to carry various articles and even other persons, on their backs. In general, such contrivances frequently include inherent design characteristics and configurations that are a compromise among aspects including ease of use, weight, size, strength, carrying capacity, comfort, ease of stowage, portability, and cost. Typically, prior art devices and articles are strong in one or more of the foregoing aspects, but weak in one or more than one others. The present disclosure provides such articles having a high level of user benefit concerning the foregoing aspects, and provides collapsible carriers that have multi-functional construction enabling them to achieve such high level of benefit in eloquent fashion, the multi-functional construction providing synergy among its components owing to their configuration and cooperative connection to one another.

SUMMARY OF THE INVENTION

This disclosure provides carriers configured to enable a person to carry cargo on their back, including other persons. A carrier according to some embodiments comprises a frame assembly having a first frame member including a top, a bottom, and a mounting plate. There is a second frame member having a perimeter, a proximal end, a distal end, and a framework disposed between the proximal and distal ends. In some embodiments the proximal end features a loop at which the second frame member is hingedly attached to the first frame member. The loop is configured to include a portion that contacts the first frame member when the second frame member is pivoted to an extended position with respect to the first frame member sufficiently to limit the span of travel of the second frame member with respect to the first frame member by such contact, such portion also providing supportive force for weight present on the framework when the second frame member is in an extended position. There is a shoulder harness attached to the frame assembly, the harness having shoulder straps configured to be received by the arms of a person sufficiently to enable the person to wear the harness on their back. In some embodiments the harness is further configured to receive and securely maintain the first frame member in a substantially vertical orientation when the person is in an upright, vertical standing position wearing the carrier.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is in no way intended to limit the present invention, uses, this disclosure, or applications.

Figure 1:
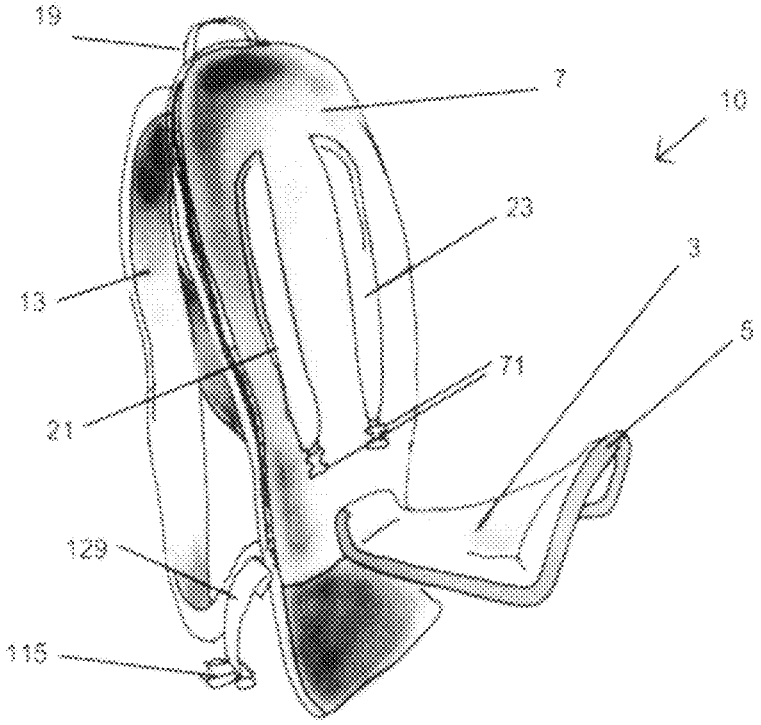
FIG. 1 is a rear perspective view of a carrier according to some embodiments of the disclosure.
Figure 7:
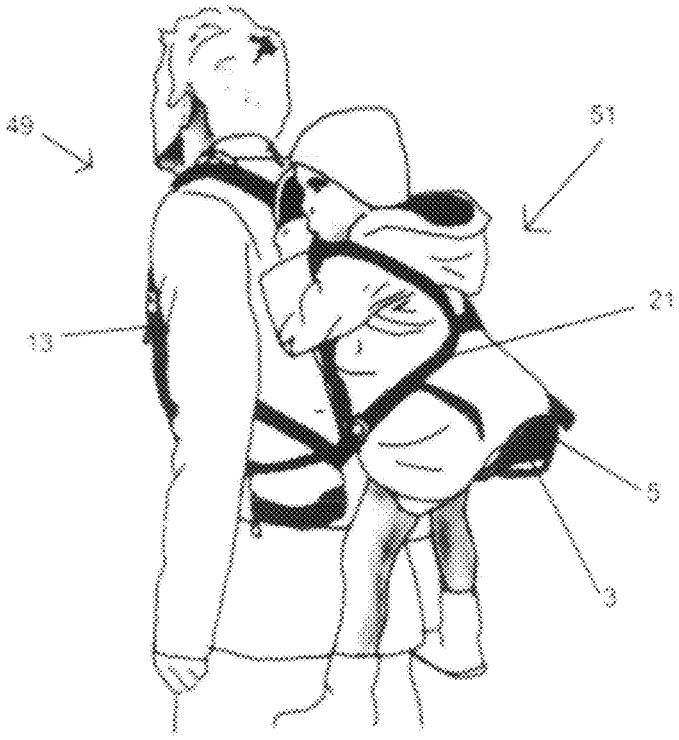
FIG. 7 is a perspective view of a wearer using a carrier according to some embodiments of the disclosure.

Referring now to the drawings, and initially to FIG. 1, there is shown a rear perspective view of a carrier 10 according to some embodiments. Carrier 10 includes seat 3 disposed about second frame member 5, seat 3 being in its extended position. Second frame member 5 is hingedly attached to first frame member 33 (FIG. 9), enabling second frame member 5 to be moved or swung to a collapsed position. There is a substrate 7 which in some embodiments is a woven material including woven nylon, canvas, polyester, etc. affixed to first frame member 33.; however, non-wovens are also suitable including without limitation non-woven polyolefins. Length-adjustable straps 21, 23 are provided having clasps 71 at their ends, clasps 71 being complementary to clasp 115 disposed at one end of a strap 129 sufficiently that when clasps 71 and 115 are engaged, a continuous strap is provided comprising straps 21, 129 that enables securing a person disposed on seat 3 to carrier 10 as illustrated in FIG. 7 using an analogous strapping setup on the side of carrier 10 not depicted. Also depicted is shoulder strap 13, which is configured to be used as a securing strap by a wearer who carries article 10 on their back. Handle 19 is in some embodiments made from a strap of woven material, nylon, polyester, etc. that is attached to substrate 7 such as by stitching or any other known means and is useful for toting carrier 10 about when not being worn or used.

Figure 2:
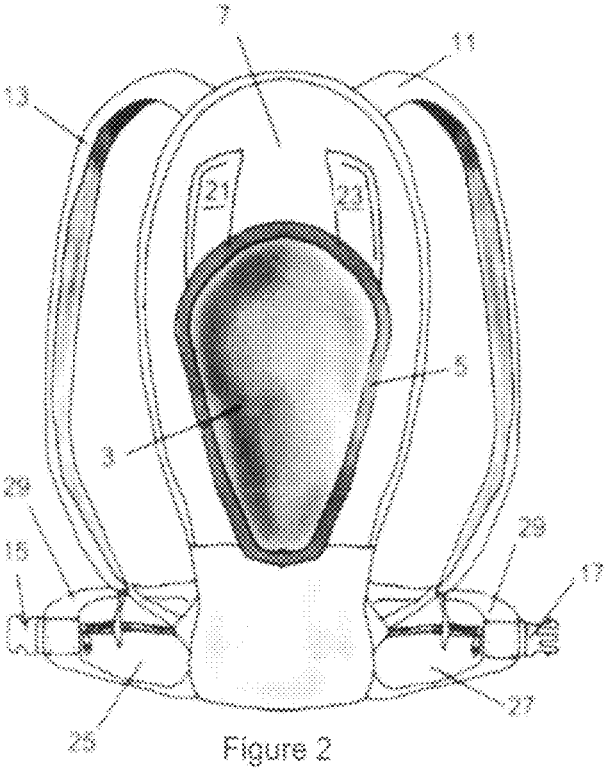
FIG. 2 is a rear view of a carrier according to some embodiments of the disclosure.
Figure 3:
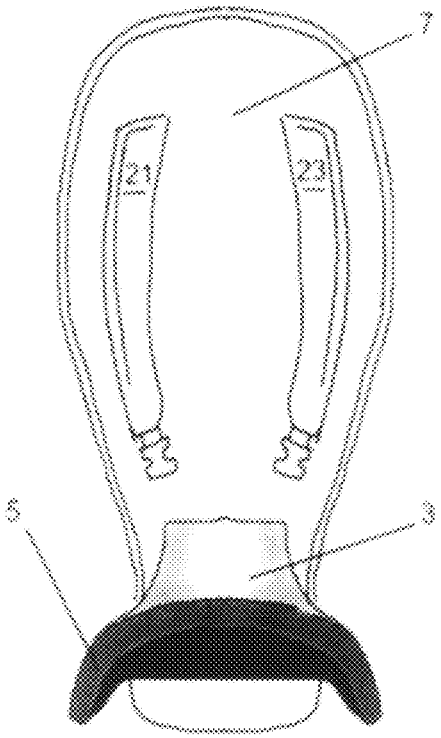
FIG. 3 is a rear view of a carrier according to some embodiments of the disclosure.
Figure 4:
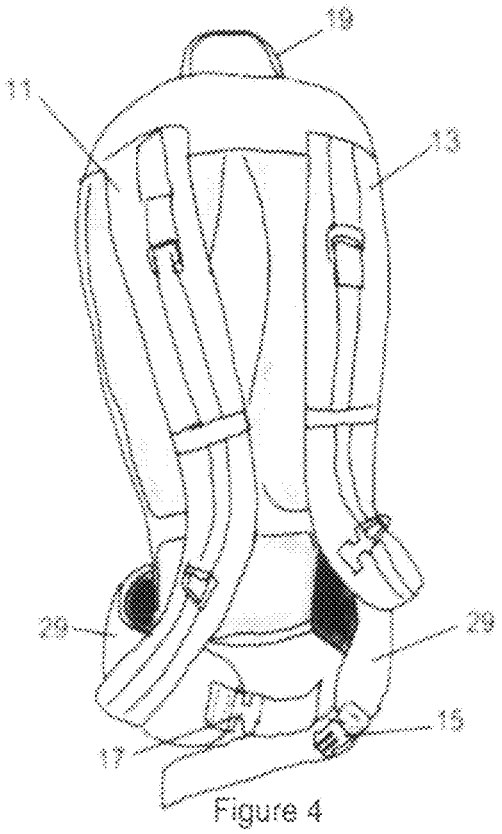
FIG. 4 is a front perspective view of a carrier according to some embodiments of the disclosure.
Figure 5:
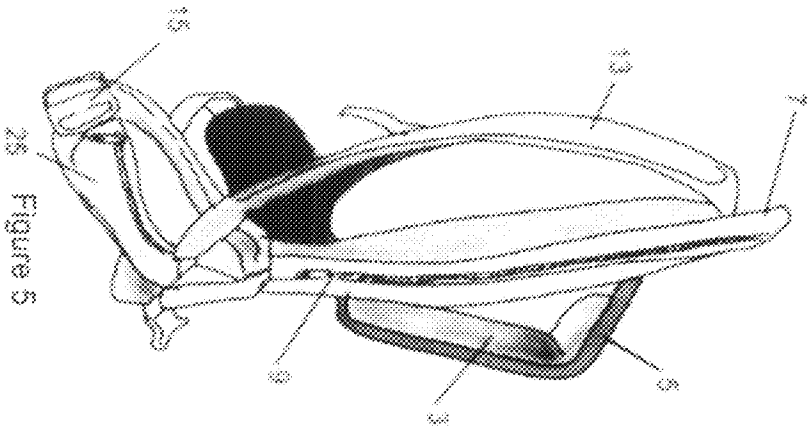
FIG. 5 is a side view of a carrier according to some embodiments of the disclosure.

FIG. 2 depicts a rear view of a carrier 10 according to some embodiments of the disclosure, illustrating the respective locations of substrate 7, straps 21, 23, shoulder straps 11, 13, second frame member 5, and seat 3 in its collapsed position. A belt 29 is present or attached at the lower portion of carrier 10, having complementary clasps 15, 17 at its opposite ends which can be joined together to provide a belt around the waist of a user who carries article 10 on their back. In some embodiments belt 29 features zippered pockets 25, 27 thereon for the convenience of a user of article 10. FIG. 3 depicts second frame member 5, substrate 7, and straps 21, 23 in a rear view of a carrier 10 according to some embodiments when seat 3 is in an extended position, and FIG. 4 is a front perspective view of a carrier according to some embodiments including shoulder straps 11, 13 handle 19, belt 29 and clasps 15, 17. In FIG. 5 is shown a right side view of a carrier according to some embodiments, illustrating the respective locations of substrate 7, seat 3, second frame member 5, pouch 25, and clasp 15, and zipper 9 disposed about any selected amount of the perimeter of the fabric of substrate 7 which when unzipped reveals a space within substrate 7, in some embodiments much akin to unzipping a tennis racquet cover reveals an inner space. Substrate 7 can be comprised of any durable material having shoulder straps attached thereto, that is also configured to be capable of receiving and securely maintaining any first frame member 33 according to this disclosure and the spirit of this invention in position either within its confines, or on its exterior. Substrate 7 and shoulder straps 11, 13 may be collectively referred to as a shoulder harness herein and in some embodiments a carrier 10 is provided by the combination of a frame assembly with a shoulder harness. A wide variety of means of achieving a suitable configuration and attachment of a frame assembly as provided herein to a shoulder harness are possible through the use of conventional fasteners, including straps, snaps, ties, cords, twine, rope, rivets, etc. and the like as appreciated by those skilled in the art upon reading this specification. In some non-limiting embodiments, a frame assembly as provided herein can be strapped to an exterior or an interior surface or connective feature thereon of an ordinary backpack acting as a shoulder harness. Some embodiments feature a single sheet of heavy canvas or the like having shoulder straps attached thereto to which a frame assembly as provided herein is affixed.

Figure 6:
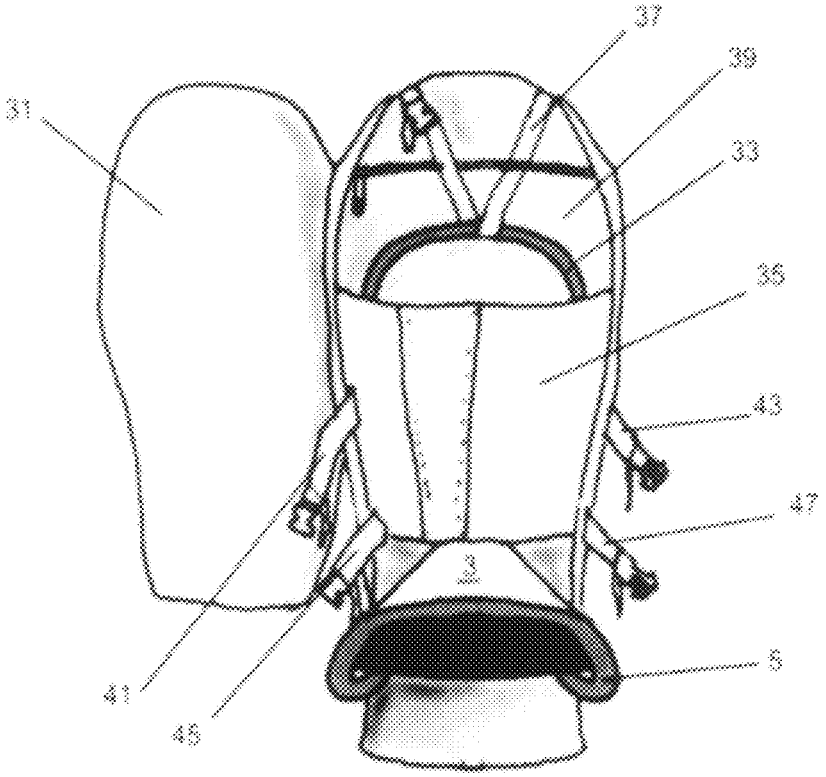
FIG. 6 is a rear view of a carrier according to some embodiments of the disclosure.

FIG. 6 is a rear view of a carrier according to some embodiments with seat 3 in an extended position, panel 31 being swung open to the position shown due to zipper 9 (FIG. 5) being unzipped, exposing inner panel 35. In some embodiments substrate 7 collectively comprises panel 31, inner panel 35, and a carrier-side panel 39 extending substantially the same dimension as panel 31, with panel 31 being attached to carrier-side panel 39 in a hinged manner, such as by stitching along their perimeters, that enables panels 31, 39 to be zipped open or shut and defining a space therebetween in which first frame member 33 can reside, securely affixed to the shoulder harness. Panel 35 in some embodiments is a piece or panel of fabric attached to carrier-side panel 39 along two of its ends as shown, such as by stitching for embodiments when the panels are comprised of a woven fabric or any other material capable of being stitched together and using conventional attachment means for any other material of construction when selected to be different from the foregoing. Further illustrated are fastener strap ends 41 and 45 having first clasps disposed at the ends thereof, and fastener strap ends 43, 47 having second clasps complimentary thereto disposed at their ends. Such arrangement enables strap ends 41, 43 to be joined to one another at the clasps, and strap ends 45, 47 to be joined to one another at the clasps. When one or more than one of strap ends 41, 43, 45, 47 are made to be adjustable in length using known means such as a fastener, a clip or buckle, etc. disposed along their length, then the grasping force from joining strap ends 41, 43, and 45, 47 to one another provides for substrate 7 to be snugly affixed to first frame member 33, for embodiments in which strap ends 41, 43 are the ends of the same strap which extends into the space between panels 31, 39 and around all or optionally any selected a portion of first frame member 33 or any feature present thereon such as a hole, hook, loop, etc, and strap ends 45, 47 are in some embodiments the ends of the same second strap which extends into substrate 7 and around all or optionally only a portion of first frame member 33. In various embodiments, strap 37 is present having two ends each of which are attached to, or to any selected location adjacent to, the perimeter or surface of carrier-side panel 39 substantially functionally as shown or otherwise described herein and including equivalents readily apparent to those skilled in the art and wrapped about or otherwise secured using conventional means to the upper portion of first frame member 33, to secure frame member 33 and carrier-side panel of carrier 10 to one another. In some embodiments more than one strap 37 is provided, as selected by engineers. In some embodiments, shoulder straps 11, 13 are attached to carrier-side panel 39 as shown in FIGS. 4, 5. FIG. 7 is a perspective view of a man 49 wearing a carrier 10 according to some embodiments of the disclosure on his back, carrier 10 having a passenger 51 (load) which may be a child residing on seat 3.

Figure 8:
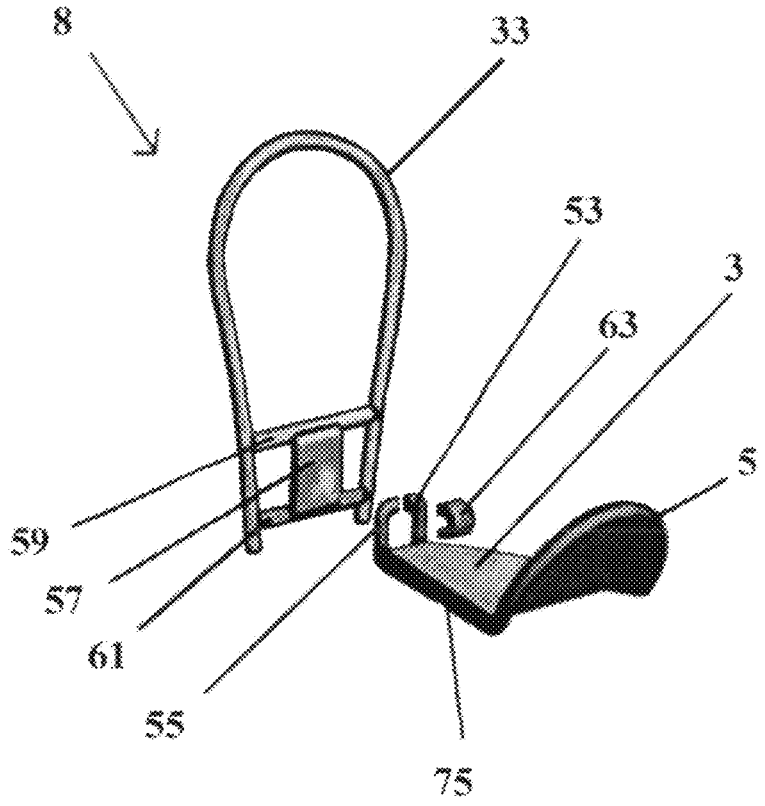
FIG. 8 is an exploded rear perspective view of a frame assembly useful in providing a carrier according to some embodiments of the disclosure.
Figure 11:
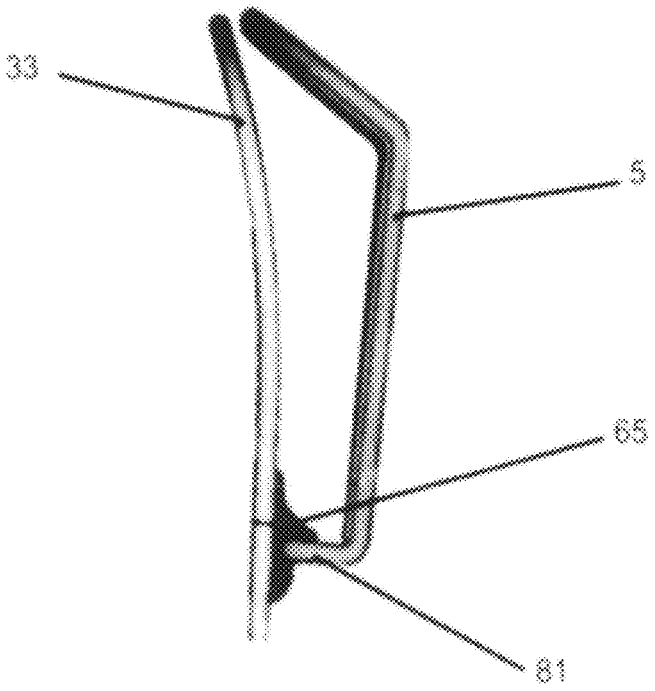
FIG. 11 is a side view of a frame assembly useful in providing a carrier according to some embodiments of the disclosure.

In FIG. 8 is depicted a rear exploded perspective view of a frame assembly useful in providing a carrier according to some embodiments of the disclosure. Frame assembly 8 in some embodiments comprises first frame member 33 which can be comprised of tubular or round stock that is bent or formed substantially to the shape shown, reminiscent of an upside-down horseshoe. In use, first frame member 33 is oriented in a substantially-vertical fashion when used on a carrier 10 as provided herein, somewhat parallel to or generally following the contour of the spine of an upright-walking person having a carrier 10 on their back analogous to how a backpack is worn. First frame member 33 has a top which in the exemplary embodiments illustrated is curved in approximately a semi-circular configuration; however, the top of first frame member 33 can be shaped as selected, including rectangular shapes, ovoid shapes, etc. and in some embodiments is open, i.e., not a closed loop, the same as or similar to the bottom of first frame member 33, regardless of whether the bottom of first frame member 33 is selected to be a closed loop or not. In some embodiments, the bottom of first frame member 33 is open and the distance between the ends is less than the distance of the widest width of first frame member 33. In some other embodiments, first frame member 33 is dimensioned so that the distance between the ends is greater than the distance of the widest width of first frame member 33, and in other embodiments the distance between the ends is the same as or about the same as the widest width of first frame member 33. In some embodiments, first frame member 33 is planar or substantially planar when viewed from a side perspective, while in other embodiments first frame member 33 appears curved or arced from such a perspective as illustrated in FIG. 11. In some embodiments such curvature contributes one synergistic aspect of both somewhat matching the spinal profile of a user of carrier 10 so configured whilst enabling the carrier's compact storage when not in use owing to accommodation of the distal end of second frame member 5 (as viewed from a side profile of FIG. 11). The accommodated portion at the distal end of second frame member 5 is in some embodiments curved, angled, or bent upwards to also provide a passenger 51 (FIG. 7) with an effective obstacle to the passenger's derriere sliding off of seat 3 when seat 3 is in an extended position. An additional, simultaneous synergy is provided by the high level of strength conferred by contact portion 81 acting on mounting plate 57 in supporting a passenger's weight, which simultaneously also acts as a stop, as later described with reference to FIG. 11. In some embodiments mounting plate 57 is a distinct piece attached to first frame member 33, and once attached thereto plate 57 effectively becomes integral with, or part of, first frame member 33. Although in some embodiments plate 57 is flat and contact portion 81 is a linear surface, it is the matching of their contours with each other which can be important. Accordingly, in some embodiments plate 57 is concave and contact portion 81 is substantially matchingly convex, while in others plate 57 is convex and contact portion 81 is substantially matchingly concave. All known geometries providing equivalent functionality are within the scope of the invention.

Provided as shown in FIG. 8 for some embodiments are supports 59, 61, each having a first end and a second end, with their first end being attached to one portion of first frame member 33 and their second end being attached to a second portion of first frame member 33, such as by welding or any conventional fastening means known to one of ordinary skill in the art. In some embodiments supports 59, 61 are tubular in cross section, in other embodiments they are solid rod or bar stock of any suitable cross-section selected.

First frame member 33, supports 59, 61 and any other element of a frame assembly 8 by itself or as part of an article provided hereby can be fabricated from any selected suitable material including without limitation metals or metallic alloys, steels, aluminum alloys, titanium and its alloys, composite materials, graphite, fiberglass, etc. In some embodiments supports 59, 61 are oriented with their longest length dimension being substantially perpendicular to the longest length dimension of first frame member 33, in some embodiments as measured from its top to its bottom. In some embodiments mounting plate 57 is provided, being attached to supports 59, 61 along a segment of each of their lengths substantially as shown, such as by welding or any conventional fastening means known to those of ordinary skill in the art. Mounting plate 57 in some embodiments is sheet stock of any selected metal or alloy thereof, in some embodiments about six millimeters thick; however, any thickness useful to function as taught herein is suitable.

In some embodiments of a carrier 10, mounting plate 57 provides a substantially-vertical surface when carrier 10 is worn or disposed on a wearer's back and is standing upright, and plate 57 functions as a "stop" to limit movement of a portion of second frame member 5 that contacts mounting plate 57 when seat 3 of article 10 is in an extended position, by engagement of plate 57 with (against) contact portion 81 of second frame member 5. In addition to providing reinforcement strength to first frame member 33, mounting plate 57 simultaneously also serves as a substrate to which affixment 63 can be attached, such as by welding or any conventional fastening means known to those of ordinary skill in the art. In some embodiments, affixment 63 is a c-shaped section of a segment of tubular stock, approximately the shape one obtains by cutting a short segment from a piece of longitudinally-sectioned length of pipe, providing a semi-circular interior that is configured to receive the ends of second frame member 5 in a hinged fashion as depicted in FIGS. 9, 10, 11.

Figure 9A:
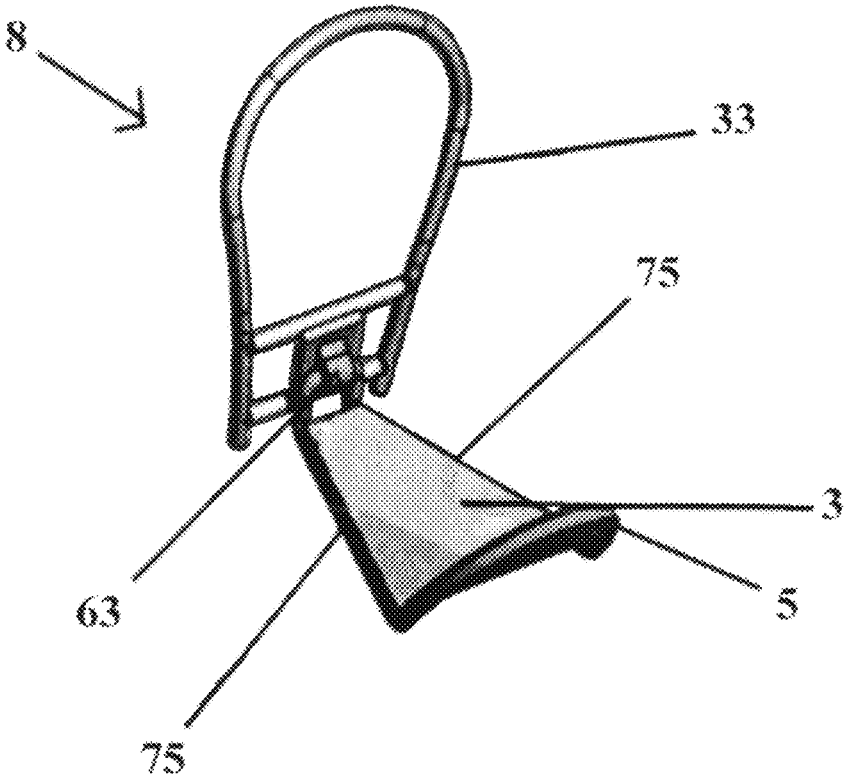
FIG. 9A is a rear perspective view of a frame assembly useful in providing a carrier according to some embodiments of the disclosure.
Figure 9B:
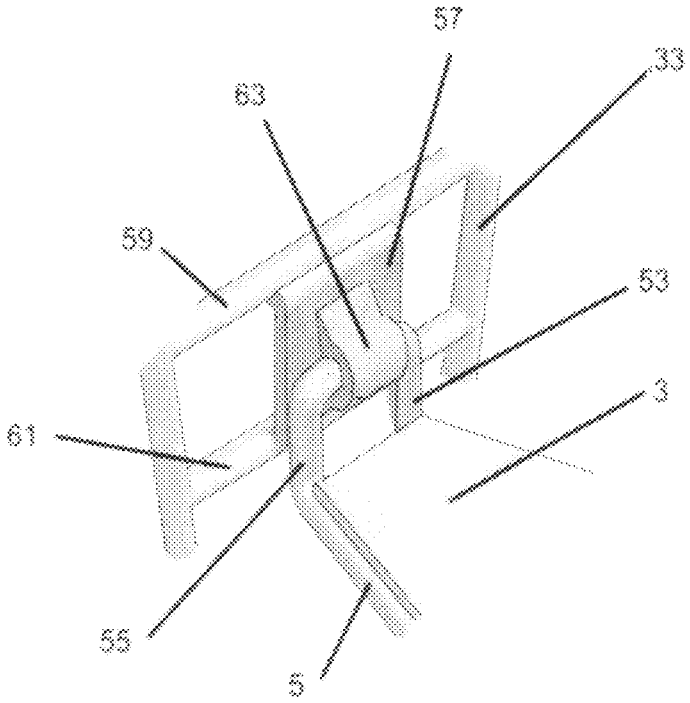
FIG. 9B is an enlarged rear perspective view of a section of a frame assembly useful according to some embodiments of the disclosure.
Figure 10:
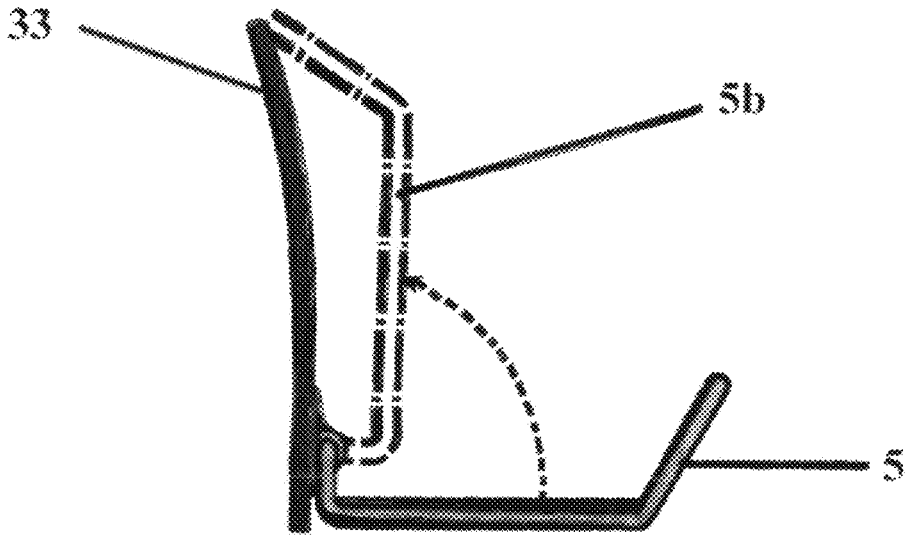
FIG. 10 is a side view of a frame assembly useful in providing a carrier according to some embodiments of the disclosure.

FIG. 9A is a rear perspective view of an assembled frame assembly useful in providing a carrier according to some embodiments of the disclosure, showing the respective locations of seat 3, second frame member 5, affixment 63, and first frame member 33. Attachment of second frame member 5 to mounting plate 57 using affixment 63 enables the hinged motion of seat 3 as illustrated in FIG. 10 where second frame member 5 can be swung up as shown, to position 5*b* in the direction of the arrow, when a carrier 10 as provided hereby is to be stored. Such stowable or collapsed configuration is illustrated further in the side view of FIG. 11, which also illustrates contact portion 81 present on the second frame member 5. Such a contact portion 81 is present near both of the ends of the single piece of bent linear stock from which second frame member 5 is fabricated, in some embodiments, as shown in FIG. 8. These contact portions 81 present at the proximal end of second frame member 5 act as "stops" to prevent the seat from being extended more than permitted by the contact of the contact portions 81 with the surface of mounting plate 57 when seat 3 is swung down from a collapsed position such as shown in FIGS. 2, 11 to an extended position such as shown in FIGS. 3, 9, the entire travel span being about 90 degrees as viewed from the side, in some embodiments. FIG. 9B is an enlarged rear perspective view of a section of a frame assembly useful according to some embodiments.

While first frame member 33 can in some embodiments be constructed of discrete elements including a frame having a top and bottom, supports, and a mounting plate, in other embodiments these elements can all be integral, for example when first frame member 33 comprises a single piece of sheet metal, or plastic injection moulded or other polymer or composite material, etc. shaped to be reasonably or substantially functional as described herein for first frame member 33, bent or formed to any selected described or functionally-equivalent shape to embodiments specifically illustrated herein, such substitution of a single piece of sheet metal or other material in such a unitary construct in place of one tubular element, two support elements and one mounting plate element being within the scope of this disclosure. Thus in some embodiments, no discrete mounting plate 57 is present, the mounting plate being effectively present at any region present on first frame member 33 that is of a thickness and/or strength suitable at that region to cooperatively function with contact portion 81 of second frame member 5 as taught herein for the invention as a whole.

Second frame member 5 is in some embodiments comprised of tubular or round stock that is bent or formed substantially to the shape depicted in some of the drawings figures, such stock so formed in some embodiments having an axis of symmetry that runs parallel to the longest length dimension of second frame member 5. In some embodiments, second frame member 5 has a proximal end at which are disposed ends 53, 55 and a distal end which can comprise a semicircular loop existing on a first plane that intersects the plane on which a central section of second frame member 5 exists, as illustrated in the side view of FIG. 10. The distal end of second frame member 5 in alternate embodiments can have a rectangular, ovoid, etc. shape at the distal end, the semicircular embodiment shown in FIG. 8 being merely exemplary and not delimitive hereof.

At the proximal end of second frame member 5 is present an upward bend (when seat 3 is in about a horizontal position) in each of the sections which are present on or in their own plane distinct from the two aforesaid, intersecting the plane on which a central section of second frame member 5 exists at an angle of about 90 degrees. The segments just beyond the upward bend with respect to a central portion of second frame member 5 comprise contact portions 81 (FIG. 11). Beyond the contact portions 81, the ends of second frame member 5 in some embodiments each make an inward bend at about 90 degrees, so that the centerlines of the ends of the tubular material from which second frame member 5 is made in some embodiments are substantially coincident with one another, which centerlines also substantially coincide with the rotational axis of second frame member 5 when swung from an extended position to a collapsed position and vice versa. In some embodiments ends 53, 55 do not contact one another and this is considered as being an open loop. In other embodiments, ends 53, 55 are fused, welded, or otherwise connected so that second frame member 5 comprises a single closed-loop construct formed from rod, tubular, or other stock. In some embodiments, second frame member 5 is comprised of tubular stock or sheet metal or other functional equivalents thereto as herein described for a second frame member 5, and there is a loop of steel, aluminum, or any other compatible alloy that is welded or otherwise rigidly attached to second frame member 5 enabling its pivotal or hinged attachment to first frame member 33 subject to the proviso that such loop is configured to include a contact area present thereon that cooperatively functions as taught herein with a mounting plate 57 or a region on first frame member 33 that is a functional equivalent of a mounting plate 57. While in some embodiments affixment 63 is a C-shaped section, first frame member 33 or mounting plate 57 is easily modified by a person in the art having even a short measure of skill to include any other known means for a hinged or pivotal attachment of a loop to a first frame member 5 to achieve the benefits taught herein; the use of such known means for pivotal or hinged attachment when achieving the benefits of the invention including its multi-complementary functions taught herein being clearly within the scope of this disclosure, which scope when mentioned herein also includes the scope of the appended claims. In some embodiments, affixment 63 can be of any chosen contour that still enables the functions taught herein, provided that the contour of the loop employed is complementary to a modified or alternative known functionally-equivalent configuration for affixment 63 sufficiently to enable hinged or pivotal attachment of the first and second frame members 33, 5.

Second frame member 5 comprises an end that is proximal to the hinged portion and an end that is distal therefrom. In some embodiments, between the distal and proximal ends there is a central section that resides substantially in or defines a first plane. In some embodiments the distal end includes a portion that resides substantially in or defines a second plane that is separate and distinct from the first plane, and the proximal end includes a portion that resides substantially in or defines a third plane that is separate and distinct from the first and second planes, the third plane being substantially parallel to mounting plate 57 or its functional equivalent in alternate embodiment frame assemblies when second frame member 5 is in an extended position. In some embodiments the central section is not linear or planar, but is smoothly curved having a continuous concave profile as viewed from a side perspective, the distal end of second frame member 5 includes a portion that resides substantially in or defines a first plane and the proximal end includes a portion that resides substantially in or defines a second plane that is separate and distinct from the first plane.

Second frame member 5 also serves the function of providing and/or providing support for a seat area for a passenger's derriere to reside along a central section of second frame member 5 when being carried on a carrier 10. In some embodiments, seat 3 is integral with second frame member 5 such as when seat 3 and second frame member 5 are both part of a single piece of stamped or otherwise fabricated sheet metal. In some embodiments a cushion and upholstery is optionally provided over the top of such sheet metal. In some embodiments, second frame member 5 is comprised of tubular stock or any selected stock contour and seat 3 comprises canvas or any other strong fabric affixed to second frame member 5 using any known conventional means including without limitation snaps, tethers, twine, cord, and metallic rings. In some embodiments, second frame member 5 is itself the seat, with no cushions or upholstery, etc. being present.

Figure 12:
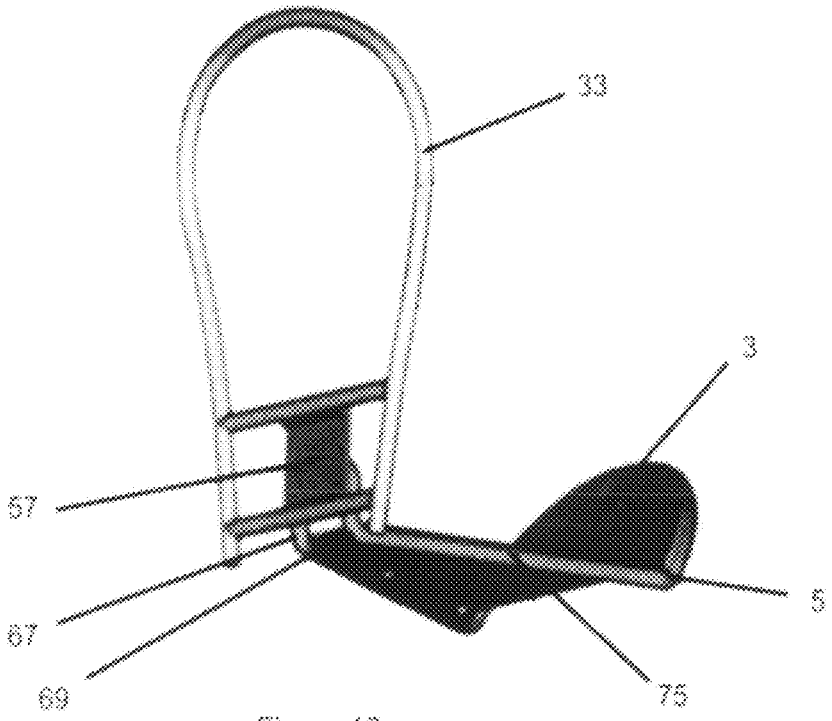
FIG. 12 is a perspective view of a frame assembly useful in providing a carrier according to some embodiments of the disclosure.
Figure 13:
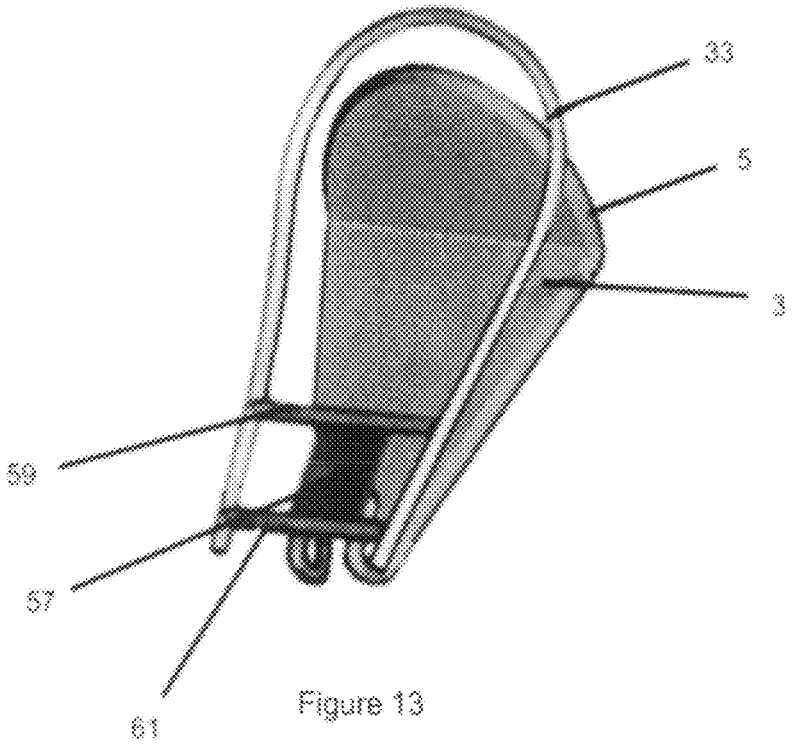
FIG. 13 is a perspective view of a frame assembly useful in providing a carrier according to some embodiments of the disclosure.

FIG. 12 is a perspective view of a frame assembly useful in providing a carrier according to some embodiments of the disclosure, showing the respective locations of first frame member 33, mounting plate 55, bend 57, bend 59, central section 75, second frame member 5 and seat 3. FIG. 13 is a perspective view of the frame assembly of FIG. 12, but in a collapsed configuration.

Figure 14:
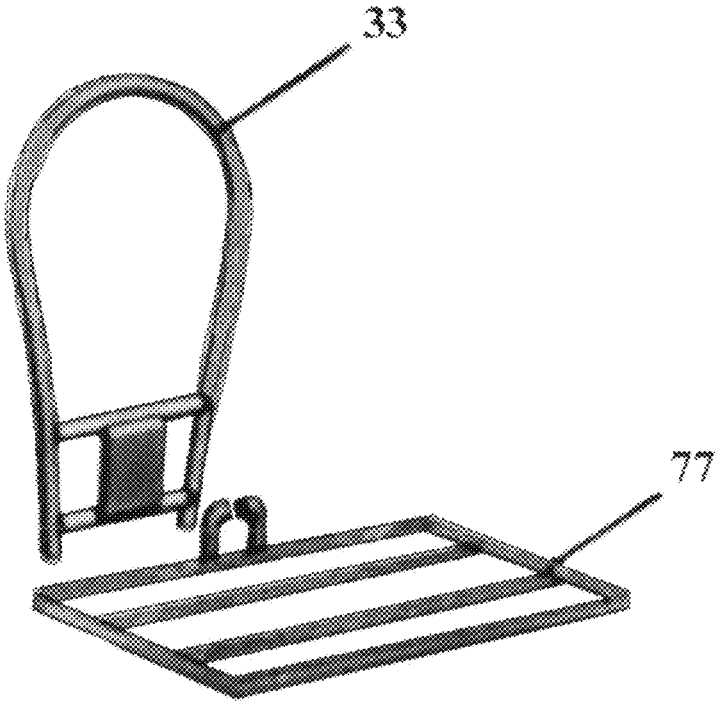
FIG. 14 is an exploded rear perspective view of a frame useful in providing a carrier according to some embodiments of the disclosure.
Figure 15:
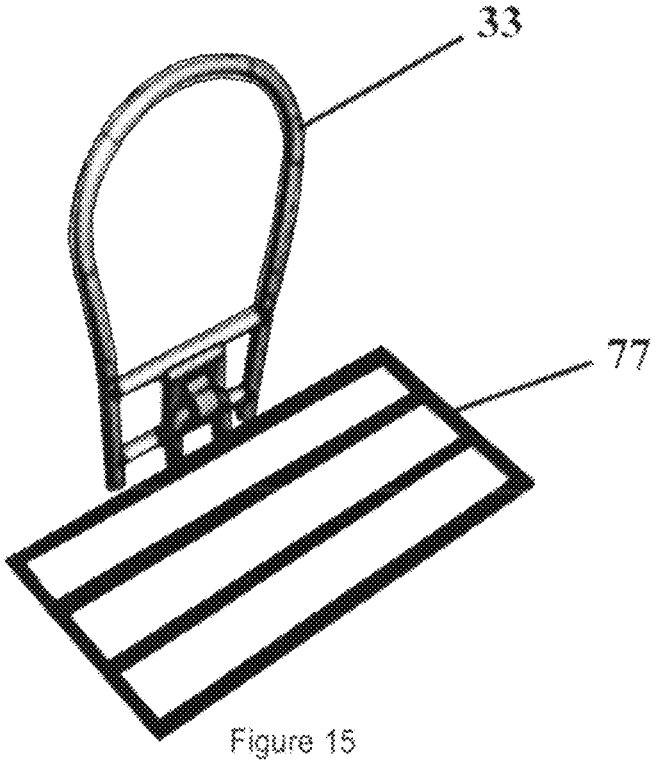
FIG. 15 is a rear perspective view of a frame useful in providing a carrier according to some embodiments of the disclosure.

FIG. 14 is an exploded rear perspective view of a frame assembly useful in providing a carrier according to some embodiments of the disclosure, wherein a grate 77 takes the place of second frame member 5, showing the versatility of the present invention in its ability to function as a carrier for not only persons but also for hauling cargo, for example, a box, duffle bag, or any other item that fits can be placed on and secured to grate 77. FIG. 15 shows a rear perspective view of an assembled frame assembly useful in providing a carrier according to some embodiments of the disclosure.

Consideration must be given to the fact that although this invention has been described and disclosed in relation to various embodiments of its cooperative function, equivalent modifications and alterations thereof are almost certain to become apparent to persons of ordinary skill in this art after reading and understanding the teachings of this specification, drawings, and the claims appended hereto. The present disclosure includes subject matter defined by any combinations of any one or more of the features provided in this disclosure with any one or more of any other features provided in this disclosure. These combinations include any combination of features described in reference to one or more than embodiments, with features described in reference to one or more other embodiments. These combinations also include the incorporation of the features and/or recitations present in any dependent claim, singly or in combination with features and/or recitations of any one or more than one of the other dependent claims, with features and/or limitations of any one or more than one of the independent claims, with the remaining dependent claims in their original text being read and applied to any independent claims so modified. These combinations also include combination of the features and/or recitations of one or more of the independent claims with features and/or recitations of another of the independent claims to arrive at a modified independent claim, with the remaining dependent claims in their original text or as modified per the foregoing, being read and applied to any independent claim so modified. The present invention has been disclosed and claimed with the intent to cover all modifications and alterations that achieve substantially the same result as within the teachings or spirit of this disclosure using substantially the same or similar structures.

The invention claimed is:

1. A carrier useful to enable a person to carry a child on their back, comprising:

A) a frame assembly having:

i) a first frame member having a top, a bottom, and a mounting plate; and ii) a second frame member having a perimeter, a proximal end, a distal end, and a central section comprising a seat disposed between said proximal and said distal ends, said central section existing in a first plane, and said distal end existing in a second plane that is angled upwardly from said first plane when said second frame member is viewed in its extended position, said proximal end having a loop at which said second frame member is hingedly attached to said first frame member at said mounting plate, said loop having a bend adjacent thereto that provides a contacting portion that contacts said mounting plate when said second frame member is pivoted to an extended position with respect to said first frame member, sufficiently to limit the span of travel of said second frame member with respect to said first frame member by such contact, such contacting portion also providing supportive force for a load present on said seat when said second frame member is in an extended position, said bend, said loop and said central section all being provided by virtue of said perimeter of said second frame member being comprised from a single piece of bent linear stock, and B) a shoulder harness attached to said frame assembly, said harness having shoulder straps configured to be received by the arms of a person sufficiently to enable said person to wear said harness on their back, said harness being further configured to receive and securely maintain said first frame member in a substantially vertical orientation when said person is in an upright, vertical standing position wearing said carrier.

2. A carrier according to claim 1 wherein said seat is oriented to be substantially horizontal with respect to said person when said person is in an upright, vertical standing position wearing said carrier and said second frame member is fully extended.

3. A carrier according to claim 1 wherein said frame assembly is removably attached to said shoulder harness.

4. A carrier according to claim 1 wherein said loop is a closed loop.

5. A carrier according to claim 4 wherein said closed loop is disposed substantially along the perimeter of said second frame member.

6. A carrier according to claim 1 wherein said loop is an open loop comprising two ends of rod stock oriented towards each another and within sufficient proximity to each another so as to enable said ends to simultaneously function as the pivotal axis for the hinged attachment of said first frame member to said second frame member.

7. A carrier according to claim 6 wherein said open loop is disposed substantially along the perimeter of said second frame member.

8. A carrier according to claim 1 wherein said first frame member is substantially horseshoe-shaped.

9. A carrier according to claim 8 wherein said first frame member is non-planar, being arced sufficiently as viewed from a side perspective to spatially accommodate at least a portion of said distal end of said second frame member when said second frame member is in a collapsed position with respect to said first frame member.

10. A carrier according to claim 1 having a cushion disposed on said second frame member.

11. A carrier according to claim 1 wherein said first frame member is of unitary construction and said mounting plate is a region present thereon located sufficiently to enable said portion of said loop that contacts said first frame member to limit the travel of said second frame member in its pivotal connection to said first frame member whilst providing supportive force for a load present on said seat when said carrier is worn about the back of a person and said second frame member is in an extended position.

12. A carrier configured to enable a person to carry cargo on their back, comprising:

A) a frame assembly comprising:

i) a first frame member having a top, a bottom, and a mounting plate; and ii) a second frame member having a perimeter, a proximal end, a distal end, a central section comprising a framework disposed between said proximal and said distal ends, said proximal end having a loop at which said second frame member is hingedly attached to said first frame member at said mounting plate, said loop having a bend adjacent thereto that provides a contacting portion that contacts said mounting plate when said second frame member is pivoted to an extended position with respect to said first frame member, sufficiently to limit the span of travel of said second frame member with respect to said first frame member by such contact, such contacting portion also providing supportive force for a load present on said framework when said second frame member is in an extended position said bend, said loop and said central section all being provided by virtue of said perimeter of said second frame member being comprised from a single piece of bent linear stock, and B) a shoulder harness attached to said frame assembly, said harness having shoulder straps configured to be received by the arms of a person sufficiently to enable said person to wear said harness on their back, said harness being further configured to receive and securely maintain said first frame member in a substantially vertical orientation when said person is in an upright, vertical standing position wearing said carrier.

13. A carrier according to claim 12 wherein said framework is substantially planar and is oriented to be substantially horizontal with respect to said person when said person is in an upright, vertical standing position wearing said carrier and said second frame member is fully extended.

14. A carrier according to claim 12 wherein said frame assembly is removably attached to said shoulder harness.

15. A carrier according to claim 12 wherein said loop is a closed loop.

16. A carrier according to claim 12 wherein said loop is an open loop comprising two ends of rod stock oriented towards each another and within sufficient proximity to each another so as to enable said ends to simultaneously function as the pivotal axis for the hinged attachment of said first frame member to said second frame member.

17. A carrier according to claim 12 wherein said first frame member is substantially horseshoe-shaped.

18. A carrier useful to enable a person to carry a child on their back, comprising:

A) a frame assembly having:

i) a first frame member having a top, a bottom, a width dimension, and two end portions, wherein said bottom of first frame member is open, and wherein the distance between said end portions is less than said width;

ii) a second frame member having a perimeter, a proximal end, a distal end, a central section comprising a seat disposed between said proximal and said distal ends, and a contacting portion, said proximal end of said second frame member being hingedly attached to said first frame member between said two ends, said contacting portion being present as two bends on said second frame member at said proximal end, said contacting portion being configured to contact said first frame member when said second frame member is pivoted to an extended position with respect to said first frame member, sufficiently to limit the span of travel of said second frame member with respect to said first frame member by such contact, such contacting portion also providing supportive force for a load present on said seat when said second frame member is in an extended position, wherein said central section of said second frame member exists in a first plane, and said distal end of second frame member exists in a second plane that angles upwardly from said first plane; and B) a shoulder harness attached to said frame assembly, said harness having shoulder straps configured to be received by the arms of a person sufficiently to enable said person to wear said harness on their back, said harness being further configured to receive and securely maintain said first frame member in a substantially vertical orientation when said person is in an upright, vertical standing position wearing said carrier.

* * * * *